US011427962B2

(12) United States Patent
Alvarado Chacon et al.

(10) Patent No.: US 11,427,962 B2
(45) Date of Patent: Aug. 30, 2022

(54) PAPER COMPRISING MICROFILAMENTS

(75) Inventors: Fresia Alvarado Chacon, Arnhem (NL); Richard Visser, Zwolle (NL); Ernst Michael Winkler, Arnhem (NL)

(73) Assignee: TEIJIN ARAMID B.V., Arnhem (NL)

( * ) Notice: Subject to any disclaimer, the term of this patent is extended or adjusted under 35 U.S.C. 154(b) by 0 days.

(21) Appl. No.: 13/978,050

(22) PCT Filed: Dec. 23, 2011

(86) PCT No.: PCT/EP2011/073968
§ 371 (c)(1),
(2), (4) Date: Jul. 2, 2013

(87) PCT Pub. No.: WO2012/093047
PCT Pub. Date: Jul. 12, 2012

(65) Prior Publication Data

US 2013/0280509 A1 Oct. 24, 2013

(30) Foreign Application Priority Data

Jan. 4, 2011 (EP) ..... 11150109

(51) Int. Cl.
*D21H 15/06* (2006.01)
*D21H 15/08* (2006.01)
*D21H 13/26* (2006.01)

(52) U.S. Cl.
CPC ..... *D21H 15/06* (2013.01); *D21H 13/26* (2013.01); *D21H 15/08* (2013.01)

(58) Field of Classification Search
USPC ..... 428/219
See application file for complete search history.

(56) References Cited

U.S. PATENT DOCUMENTS

| | | | | |
|---|---|---|---|---|
| 2,999,788 | A * | 9/1961 | Morgan | D01D 5/04 162/146 |
| 3,756,908 | A | 9/1973 | Gross | |
| 4,548,678 | A * | 10/1985 | Laflin et al. | 162/146 |
| 4,729,921 | A | 3/1988 | Tokarsky | |
| 5,393,601 | A | 2/1995 | Heinrich et al. | |
| 6,120,643 | A * | 9/2000 | Levit | D21H 13/26 162/146 |
| 6,407,017 | B1 * | 6/2002 | Wada et al. | 442/335 |
| 2004/0140072 | A1 * | 7/2004 | Kinsley, Jr. | D21H 13/26 162/146 |
| 2005/0284595 | A1 | 12/2005 | Conley et al. | |
| 2007/0137818 | A1 * | 6/2007 | Levit | C09K 3/1028 162/146 |
| 2007/0167101 | A1 * | 7/2007 | Naruse | D21H 13/26 442/414 |
| 2008/0217379 | A1 * | 9/2008 | Abramovici | B23K 20/10 228/124.1 |
| 2009/0155526 | A1 * | 6/2009 | Levit | B32B 3/12 428/116 |
| 2009/0214818 | A1 | 8/2009 | Levit et al. | |

FOREIGN PATENT DOCUMENTS

| | | | |
|---|---|---|---|
| CN | 101748646 | A | 6/2010 |
| EP | 0 994 215 | A1 | 4/2000 |
| EP | 1113469 | A2 | 7/2001 |
| JP | H10-292289 | A | 11/1998 |
| JP | 2001-244150 | A | 9/2001 |
| JP | 2003-234897 | A | 8/2003 |
| JP | 2003-306885 | A | 10/2003 |
| JP | 2004-162193 | A | 6/2004 |
| JP | 2006-200066 | A | 8/2006 |
| JP | 2008-095223 | A | 4/2008 |
| WO | 03/093576 | A1 | 11/2003 |
| WO | WO 2005/059247 | A1 | 6/2005 |
| WO | 2009-108672 | A2 | 9/2009 |

OTHER PUBLICATIONS

Feb. 17, 2012 International Search Report issued in International Application No. PCT/EP2011/073968.
Feb. 17, 2012 Written Opinion of the International Searching Authority issued in International Application No. PCT/EP2011/073968.
Mar. 25, 2020 Annex Letter.
May 11, 2020 Letter of Proprietor.
Dec. 12, 2019 Test Report on Making and Testing Lab Paper.
Sep. 13, 2019 Letter—Reply to Appeal.
Dec. 20, 2019 Letter of the Opponent-Appellant.
Sep. 13, 2019 Information on Starting Materials.
Jun. 28, 2019 PTS Test Report PTS TEC 29/2019.
Mar. 11, 2019 PTS Test Report PTS TEC Dec. 2019.
Apr. 26, 2019 Annex 4.
Apr. 26, 2019 Annex 5.
Apr. 26, 2019 Statement of Grounds of Appeal.
Dec. 21, 2018 Annex to the Communication.
Dec. 21, 2018 Decision.
Dec. 21, 2018 Grounds for the Decision.
Oct. 30, 2018 Technical Report 3, Annex 3 (Opponent).
Oct. 30, 2018 Written Submission Opponent.
Sep. 7, 2018 Second Test Report (Proprietor).
Sep. 7, 2018 Written Submission Proprietor.
Jul. 17, 2018 Technical Report 2, Annex 2 (Opponent).
Jul. 17, 2018 Written Submission Opponent.
Dec. 21, 2017 Test Report (Proprietor).
Dec. 21, 2017 Reply of Proprietor.
Jul. 18, 2017 Test Report, Annex 1 (Opponent).
Jul. 18, 2017 Facts and Arguments in Support of the Opposition.
Opposition/Appeal document mailed Jul. 31, 2020 in European Patent Application No. 11807929.2 (European Patent 2 661 522).

* cited by examiner

*Primary Examiner* — Frank J Vineis
*Assistant Examiner* — Laura B Figg
(74) *Attorney, Agent, or Firm* — Oliff PLC

(57) ABSTRACT

Paper with a grammage of 10-100 g/m$^2$ including at least 20 wt. % of microfilaments and at least 20 wt. % of a non-resinous binder, the microfilaments having an average filament length in the range of 2-25 mm and titer less than 1.3 dtex, the non-resinous binder comprising at least one of fibril or pulp. The paper shows high strength and other attractive properties.

13 Claims, No Drawings

PAPER COMPRISING MICROFILAMENTS

BACKGROUND

The invention pertains to a paper comprising microfilaments.

Technical papers are known in the related art and are being used for electrical isolation, honeycombs, pressboards or as separator sheets. Such papers are often made of aramid material and comprise short cut fibers and a binder, like fibrids or pulp.

EP994215 describes a wholly aromatic polyamide fiber synthetic paper sheet including an aramid staple fiber component which includes aramid stable fibers with at least two annular projections.

US2007/0137818 describes a para-aramid pulp comprising meta-aramid fibrids for use as reinforcement material.

US2005/0284595 describes the use of cellulosic and para-aramid pulp for use in seals and friction materials.

A problem can be that the paper shows insufficient strength or otherwise inadequate properties when used in certain applications. In that case, the tensile and/or tear strength of the paper should be increased, preferably without increasing the grammage of the paper.

The aim of the idea concerns a paper, which overcomes the problem of the related art.

BRIEF SUMMARY

The present invention provides such a paper. The invention pertains to a paper with a grammage of 10-100 g/m2 comprising at least 20 wt. % of microfilaments and at least 20 wt. % of a non-resinous binder, the microfilaments having an average filament length in the range of 2-25 mm and titer less than 1.3 dtex, the non-resinous binder comprising at least one of fibrid or pulp.

Due to the use of microfilaments the paper of this invention is stronger (at the same areal weight) or is lighter (at the same strength) than comparable papers without microfilaments, and shows better performance in numerous applications.

DETAILED DESCRIPTION

The microfilaments in the paper according to the invention are individual threads with the stipulated parameters. They can be distinguished from fibrillated pulp, which consists of fibers which have been subjected to a shearing force leading to the formation of fibrils, which are mostly connected to a "stem" of the original fiber, while thinner fibrils peel off from the thicker fibrils. In general, fibrils are curly and sometimes ribbon-like, and show variations in length and thickness.

The microfilaments used in the present invention have a number-average length in the range of 2-25 mm. In a preferred embodiment the average length is at least 3 mm. In some embodiments it may be at least 4 mm. The average length of the microfilaments preferably is at most 15 mm, in one embodiment at most 8 mm. In one embodiment, the length distribution of the microfilament is such that at least 50 number % of the filaments have a length which is within 30% of the length at a peak maximum in the length distribution curve. Preferably, at least 70 number % of the filaments have a length which is within 30% of the length at a peak maximum in the length distribution curve. This goes for monomodal and for multimodal filament length distributions, wherein for multimodal distributions at least 50 number % of the filaments have a length which is within 30% of the length at any one of the peak maxima in the length distribution curve.

In one embodiment, the microfilament is less than 1.3 dtex, more preferred less than 1.2 dtex. In one embodiment, the titer of the microfilament is 1.0 dtex or less. In one embodiment, the microfilament titer is at least 0.3 dtex, in particular at least 0.4 dtex, in some embodiments at least 0.5 dtex.

In another embodiment, the microfilaments have an average diameter of 1 to 499 nm, in particular 50-300 nm. These microfilaments are generally thinner than the microfilaments in the previous paragraph, and may also be indicated as nanofilaments.

In contrast with fibrils, the microfilaments in the present invention generally have a relatively homogeneous titer. In one embodiment, the titer distribution of the microfilament is such that at least 50 number % of the filaments have a titer which is within 30% of the titer at a peak maximum in the titer distribution curve. This goes for monomodal and for multimodal filament titer distributions. Preferably, at least 70 number % of the filaments have a titer which is within 30% of the titer at a peak maximum in the titer distribution curve.

In contrast with fibrils, the microfilaments in the present invention generally have a relatively homogeneous diameter. In one embodiment, the diameter distribution of the microfilament is such that at least 50 number % of the filaments have a diameter which is within 30% of the diameter at a peak maximum in the diameter distribution curve. This goes for monomodal and for multimodal filament diameter distributions. Preferably, at least 70 number % of the filaments have a diameter which is within 30% of the diameter at a peak maximum in the diameter distribution curve.

In has been found that the use of microfilaments which are relatively long as compared to their thickness, or relatively thin as compared to their length, show particularly advantageous properties. In one embodiment, the aspect ratio, in this specification defined as the length/titer is at least 4 mm/dtex, in particular at least 5 mm/dtex. In some embodiments, the aspect ratio is at least 7 mm/dtex, or even at least 10 mm/dtex.

This may be of particular importance where the filaments are relatively short. Thus, in one embodiment, where the microfilaments are relatively short, e.g., having an average length of below 4 mm, or below 5 mm, they have an aspect ratio of at least 4 mm/dtex, in particular at least 5 mm/dtex, least 7 mm/dtex, or even at least 10 mm/dtex.

Preferably, the microfilaments are of meta-aramid or para-aramid, such as poly(para-phenylene terephthalamide), poly(meta-phenylene isophthalamide), copoly(para-phenylene/3,4'-dioxydiphenylene terephthalamide) and the like, products of some of which are commercially available under the trade names Nomex®, Kevlar®, Twaron®, Conex®, and Technora®.

Para-oriented aromatic polyamides are condensation polymers of a para-oriented aromatic diamine and a para-oriented aromatic dicarboxylic acid halide (hereinafter abbreviated to "para-aramids"). As typical members of para-aramid are mentioned the aramids of which structures have a poly-para-oriented form or a form close thereto, such as poly(praraphenylene terephthalamide), poly(4,4'-benzanilide terephthalamide), poly(praraphenylene-4,4'-biphenylenedicarboxylic acid amide) and poly (praraphenylene- 2,6-naphthalenedicarboxylic acid amide). The preferred aramid is para-aramid, more preferably poly(para-phenylene terephthalamide) (PPTA).

In this specification the term fibers pertains to a fiber having a titer higher than 1.3 dtex. These fibers can be long (for example endless fibers) or short cut fibers (average length in the range of 2 to 25 mm).

In this specification the term fibrids refers to small, non-granular, non-rigid fibrous or film-like particles. The film-like fibrid particles have two of their three dimensions in the order of microns, and have one dimension less than 1 micron. Their smallness and suppleness allows them to be deposited in physically entwined configurations such as are commonly found in papers made from wood pulp. Meta-aramid fibrids may be prepared by shear precipitation of polymer solutions into coagulating liquids as is well known from U.S. Pat. No. 2,999,788. In this invention only fibrids of the film-like type (also called filmy fibrids) are used. Fibrids of wholly aromatic polyamides (aramids) are also known from U.S. Pat. No. 3,756,908, which discloses a process for preparing poly(meta-phenylene isophthalamide) (MPD-I) fibrids in column 5 lines 37-54. Before use in paper or pressboard manufacture, the fibrids can be refined to provide improved electrical properties in the products made thereof and also to provide better sheet quality on paper forming machines. Para-aramid fibrids, as herein defined, cannot be made by these common methods and are made via a much later developed jet spin process such as described in EP 1694914. Preferably in the present invention aramid fibrids are used, more in particular meta-aramid fibrids or para-aramid fibrids. The use of para-aramid fibrids, in particular PPTA fibrids, is considered particularly preferred.

Pulp in the present specification refers to a material that comprises fibrils. In one embodiment pulp is obtained through subjecting a fiber-like material to a pulping process involving subjecting fibers to shear. Pulp is known in the art and requires no further explanation here. In the process according to the invention pulp of various types may be used. In one embodiment aramid pulp is used, more in particular para-aramid pulp. The use of para-aramid pulp, in particular PPTA pulp, is considered particularly preferred. In another embodiment, cellulose pulp is, used. Combinations of various types of pulp, such as aramid pulp and cellulose pulp are also envisaged.

The amount of microfilament in the paper may vary in wide ranges. In one embodiment, the amount is in the range of 20-45 wt. %, in particular 20-35 wt. %. In another embodiment the amount is in the range of >45-80 wt. %, in particular 50-70 wt. %.

In one embodiment, the paper comprises at least 20 wt. % of pulp. In one embodiment, the paper comprises 30-80 wt. % of pulp, e.g., cellulose pulp. It has been found that the use of cellulose pulp renders the paper production cheaper and easier. In one embodiment, the paper comprises 20-80 wt. % of aramid pulp, in particular 20-50 wt. %.

In one embodiment the paper comprises at least 20 wt. % of fibrids. Especially preferred, the paper comprises between 30 to 80 wt. % % of fibrids, most preferred between 50 to 60 wt. %.

The paper according to the invention has an areal weight of 10-100 g/m2. The areal weight of all types of paper and paperboard is measured according to ISO 536:1995 and expressed in terms of grams per square meter (g/m$^2$). This quantity is commonly called grammage. In one embodiment, the paper according to the invention has a grammage of less than 60 g/m2, more in particular less than 40 g/m2. It has been found that the paper according to the invention can be particularly advantageous for papers with such low grammage for the following reason. When making a lighter paper the coverage of the paper can be a problem resulting in larger holes in the paper. By the use of microfilaments the coverage of the paper can be improved, whereby smaller holes exist in the paper in comparison with papers of the same grammage, but without microfilaments.

The paper may be manufactured through processes known in the art, which do not require further elucidation here.

The papers according to the invention have attractive properties, including improved strength, improved tear index, and improved elongation at break. Further, the size of the pores may be decreased. The paper is therefore suitable in numerous applications, including use as separator, e.g., in fuel cells, batteries, or capacitators. The papers are also suitable for use in filter applications, electrical isolation, printed wiring board, or in packaging.

It has been found that the papers according to the invention are particularly suitable for use in honeycombs, where they provide a significant improvement in the shear properties of the honeycomb. Accordingly, the present invention also pertains to a honeycomb comprising the paper of the present invention, as described above.

The following non-limiting examples serve to illustrate the invention.

EXAMPLE 1

Investigation of Tensile Strength

All papers were made by the process described in ISO 5269-1 for the British sheet mould, ISO 5269-2 for the Rapid Koethe sheet former. The tensile index was measured for all paper according to ISO 1924-2.

The first paper was made by the process outlined above and comprised 30% of microfilaments. The microfilaments were made of para-aramid (Type 2000 produced by Teijin Aramid), had an average length of 6 mm and a titer of 0.9 dtex. In addition, the paper comprised 70% of fibrids (Type 8016 produced by Teijin Aramid) made of para-aramid. The paper was made on the British sheet mould (ISO 5269-1) and the grammage was 40 g/m$^2$. After the paper making process the wet paper was placed between two blotting papers and calendered between two steel rolls (both 150° C.) to a density of approximately 0.9 g/cm$^3$.

The second paper distinguished from the first paper only in the content of microfilaments and fibrids. The second paper contained 50% of microfilaments and 50% of fibrids. All other features of the first paper were retained in the second paper.

The third paper distinguished from the first paper in the content of microfilaments and fibrids. The third paper comprised 70% of microfilament and 30% of fibrids. All other features of the first paper were retained in the third paper.

The fourth paper was made by the above-mentioned process and comprised 30% of fibers with an average length of 6 mm and a count of 1.7 dtex. Therefore, these kinds of fibers were no microfilaments in the term of this invention. The fibers were made of para-aramid (Type 1000, produced by Teijin Aramid). The paper comprised also 70% of fibrids (Type 8016) made of para-aramid. The paper was made on the British sheet mould and the grammage was 40 g/m$^2$. After the paper making process the wet paper was placed between two blotting papers and calendered between two steel rolls (both 150° C.) to a density of approximately 0.9 g/cm$^3$.

The fifth paper distinguished from the fourth paper only in the content of fibers and fibrids. The fifth paper was made of 50% of fibers and 50% of fibrids. All other features of the fourth paper were retained in the fifth paper.

The sixth paper distinguished from the fourth paper in the content of fibers and fibrids. The sixth paper comprised 70% of fibers and 30% of fibrids. All other features of the fourth paper were retained in the sixth paper.

The fourth, fifth and sixth paper are comparative examples for this invention, whereas the first, second and third paper build up the Examples according the present invention.

TABLE 1

| Paper | Tensile Index (Nm/g) |
|---|---|
| 1 | 92 |
| 4 (comparative) | 85 |
| 2 | 118 |
| 5 (comparative) | 101 |
| 3 | 125 |
| 6 (comparative) | 113 |

As can be seen from Table 1 the tensile Index of the first paper (92 Nm/g) is higher than the tensile index of the fourth paper (85 Nm/g), which distinguishes from the first paper only in the use of microfilaments instead of fibers. Also the tensile Index of the second paper (118 Nm/g) is higher than the tensile Index of the fifth paper (101 Nm/g) and the tensile Index of the third paper (125 Nm/g) is higher than the tensile Index of the sixth paper (113 Nm/g). The second paper exhibits the same material content as the fifth paper with the exception that in the second paper microfilaments are used instead of fibers (fifth paper). Also the third paper and the sixth paper exhibit the same mixing ratio with the exception, that in the third paper microfilaments are used instead of fibers (like in the sixth paper). Therefore Table 1 shows that the use of microfilaments in a paper increases the tensile strength of a paper. Table 1 shows additionally that the tensile strength increases in respect of the content of microfilaments in the paper—the higher the content of microfilaments, the higher the tensile strength of the paper.

EXAMPLE 2

Investigation of Tear Strength and Elongation at Break

All papers were made on a Rapid Koethe sheet former (ISO 5269-2) and had an areal weight of about 57 g/m$^2$. The tear strength was measured by ISO 1974. The elongation at break was measured by ISO 1924-2.

The first paper was made of 80% of cellulose pulp (OCC) and 20% of para-aramid microfilaments (type 2000, produced by Teijin Aramid), whereby the microfilaments had an average fiber length of 13 mm and a titer of 0.9 dtex. After the paper making process the paper was not calendered.

The second paper was made of 70% of cellulose pulp (OCC) and 20% of type 1000 para-aramid microfilaments. Also in this paper the microfilaments exhibited an average length of 13 mm and a titer of 0.9 dtex. The second paper exhibited also 10% of para-aramid fibrids (Type 8016 produced by Teijin Aramid). After the paper making process the paper was not calandered.

The third paper distinguished from the first paper by using fibers instead of microfilaments. This means the third paper comprised 80% of cellulose pulp and 20% of para-aramid fibers (Type 1000, produced by Teijin Aramid), whereby the fibers had an average length of 13 mm but a titer of 1.7 dtex (and therefore no microfilaments were present).

The fourth paper distinguished from the second paper also in the use of fibers instead of microfilaments. The fourth paper comprised 70% of cellulose pulp, 20% of para-aramid fibers (Type 1000) and 10% of fibrids (Type 8016). The fibers had an average length of 13 mm and a titer of 1.7 dtex.

The third and the fourth paper are comparative examples for this invention, whereas the first and the second paper build up the Examples according the present invention.

TABLE 2

| Paper | Tear Index (mNm$^2$/g) | Elongation at break (%) |
|---|---|---|
| 1 | 16.8 | 0.82 |
| 3 (comparative) | 11.7 | 0.75 |
| 2 | 34.6 | 1.33 |
| 4 (comparative) | 23.6 | 1.14 |

Table 2 shows that the use of microfilaments instead of fibers increases the tear index. As can be seen from table 2 also the elongation at break increases by using microfilaments instead of fibers.

In conclusion, the papers comprising microfilaments exhibit therefore a higher tensile strength, a higher tear strength and a higher elongation at break in comparison to papers using fibers instead of microfilaments.

EXAMPLE 3

Honeycombs Based on Papers According to the Invention

The first paper was made by the process outlined above and comprised 50% of microfilaments (Twaron 2000 produced by Teijin Aramid) with a length of 6 mm and a titer of 0.9 dtex. In addition, the paper comprised 50% of fibrids (Type 8016 produced by Teijin Aramid) made of para-aramid. The paper was made on a paper machine and the grammage was 33.2 g/m$^2$. The dry paper was calendered between two steel rolls (120° C.) to a density of 0.85 g/cm$^3$. From this paper, a honeycomb was made with a cell size of 3.4 mm and a density of ca. 53 kg/m$^3$. This honeycomb was tested in compression according to ASTM-C365 and in shear according to ASTM-C273. The results are given in the table.

The second paper was made according to the first paper, but now the microfilaments were replaced by standard filaments (Twaron 1000 produced by Teijin Aramid) with a length of 6 mm and a titer of 1.7 dtex. The grammage of the paper was 34.0 g/m$^2$ and the density after steel-steel calendering at 120° C. 0.87 g/cm$^3$. From this paper, a honeycomb was made with a cell size of 3.4 mm and a density of ca. 53 kg/m$^3$. The honeycomb was tested on mechanical properties, see table for results.

TABLE 3

| | | Honeycomb based on Paper 1 (invention) | Honeycomb based on Paper 2 (comparative) |
|---|---|---|---|
| Compression strength | (MPa) | 2.79 | 2.78 |
| Shear strength (L-direction) | (MPa) | 1.85 | 1.57 |
| Shear strength (W-direction) | (MPa) | 1.12 | 0.92 |

TABLE 3-continued

| | | Honeycomb based on Paper 1 (invention) | Honeycomb based on Paper 2 (comparative) |
|---|---|---|---|
| Shear modulus (L-direction) | (MPa) | 103 | 98 |
| Shear modulus (W-direction) | (MPa) | 67 | 54 |

From this it is clear that replacing filaments with standard diameter by microfilaments significantly improve the shear properties of the honeycomb.

The invention claimed is:

1. A paper with a grammage of 10-100 g/m$^2$ comprising:
at least 20 wt. % of microfilaments, and
at least 30 wt. % of a non-resinous binder, wherein
the microfilaments have an average filament length in the range of 2-25 mm and a titer of 0.5-1.3 dtex,
the non-resinous binder comprises fibrids,
the microfilaments are para-aramid microfilaments and the fibrids are aramid fibrids,
the paper comprises at least 30 wt. % of fibrids as the non-resinous binder, and
the paper is substantially free of aramid pulp; wherein the fibrids are non-granular, non-rigid film-like particles having two of their three dimensions in the order of microns and have having one dimension less than one micron, and wherein the pulp comprises fibrils.

2. The paper according to claim 1, wherein the paper comprises at least 20% of pulp, the pulp being comprised in the paper being free of aramid pulp.

3. The paper according to claim 2, wherein the wt. % of fibrids is higher than a wt. % of pulp.

4. The paper according to claim 1, wherein the paper comprises at least 20% of cellulose pulp.

5. The paper according to claim 1, wherein the aramid fibrids of the non-resinous binder comprise meta-aramid fibrids and/or para-aramid fibrids.

6. The paper according to claim 1, wherein the length of the microfilaments is at least 3 mm.

7. The paper according to claim 1, wherein the microfilament titer is less than 1.2 dtex.

8. The paper according to claim 1, wherein the paper has a grammage of less than 60 g/m$^2$.

9. The paper according to claim 1, wherein the filaments have an aspect ratio of a least 4 mm/dtex.

10. The paper according to claim 1, wherein the paper further comprises at least 20% of pulp as the non-resinous binder.

11. The paper according to claim 1, wherein the length of the microfilaments is at most 15 mm.

12. The paper according to claim 1, wherein the microfilaments are individual threads, a diameter distribution of the microfilaments is such that at least 50 number % of the filaments have a diameter that is within 30% of the diameter at a peak maximum in the diameter distribution curve, and a titer distribution of the microfilaments is such that at least 50 number % of the filaments have a titer which is within 30% of the titer at a peak maximum in the titer distribution curve.

13. A fuel cell, a battery, a capacitor, a printed wiring board, a honeycomb, a packaging, a separator for electrical isolation, or a filter comprising the paper according to claim 1.

* * * * *